US005472120A

United States Patent [19]

Stebick et al.

[11] Patent Number: 5,472,120

[45] Date of Patent: Dec. 5, 1995

[54] BOTTLE WITH TWO-STAGE OPENING

[75] Inventors: Matthew E. Stebick, Waterford; Robert J. Smith, Edinboro, both of Pa.

[73] Assignee: Erie Plastics, Corry, Pa.

[21] Appl. No.: 221,242

[22] Filed: Mar. 31, 1994

[51] Int. Cl.[6] ..... B67D 5/32

[52] U.S. Cl. ..... 222/153.06; 222/482; 222/486; 222/509; 222/523; 222/524; 222/525

[58] Field of Search ..... 222/153, 212, 222/481, 482, 483, 484, 485, 486, 509, 522, 523, 524, 525, 559

[56] References Cited

U.S. PATENT DOCUMENTS 4,314,656 2/1982 Kessler ..... 222/525 X
4,771,923 9/1988 Zinnbauer ..... 222/153
4,927,065 5/1990 Beck ..... 222/525 X
4,979,648 12/1990 Montgomery et al. ..... 222/153
5,104,008 4/1992 Crisci ..... 222/153

*Primary Examiner*—Andres Kashnikow
*Assistant Examiner*—Joseph A. Kaufman
*Attorney, Agent, or Firm*—Oliff & Berridge

[57] ABSTRACT

A cap for a container has three distinct positions, including a closed position, an intermediate spray position and a fully open pour position. The cap provides a fluid tight seal when in the closed position and provides a fluid tight seal from pouring when in the spray position. The cap includes a shell defining a fluid passage to the container and a tip with pouring and spraying apertures axially movably secured to the shell. The tip is pulled up to select a dispensing position, which causes a stem disposed in the shell to engage or disengage with an aperture in the tip, depending on the selected dispensing option.

48 Claims, 7 Drawing Sheets

BOTTLE WITH TWO-STAGE OPENING

BACKGROUND OF THE INVENTION

1. Field of the Invention

This invention relates to a cap for a container that can be opened to spray or to pour a fluid. More specifically, this invention relates to a push/pull type cap for a plastic bottle.

2. Description of Related Art

Plastic bottles typically have caps that are twisted or pulled open to dispense fluid and provide a seal against leaking. An example of a conventional squeeze bottle with a sealing cap that is pulled open and pushed closed is a typical cleanser bottle commonly used for dishwashing detergent. This bottle typically has a shell portion secured to the bottle body with a single, solid central stem surrounded by an annular channel with openings therein for fluid to pass from the bottle body to the cap. A tip is axially movably disposed on the shell with one large central opening that sealingly engages the stem in the closed position and is spaced from the stem in the open position. In operation, the tip is merely pulled up to dislodge the stem from the aperture whereby fluid can be dispensed from the bottle body.

Other types of conventional caps function by twisting. In these types of caps, a dispensing aperture is located off center of the tip of the cap. The shell is secured to the container body and has an upstanding stem positioned off center and aligned with the aperture in the tip. In a closed position, the stem covers and seals the aperture. In operation, the tip is rotated to one side, thus uncovering the aperture and allowing fluid to flow from the container body through the cap.

Some of these twisting type caps offer both a spray and a stream feature. In these caps, there is a spray opening and a stream opening both provided off center on the tip of the cap. An enlarged stem, which is generally arc-shaped, is disposed beneath both the spraying aperture and the stream aperture in the closed position. In operation, a user twists the tip of the cap to displace the desired aperture from the stem. Thus, twisting in one direction will uncover, for example, the spraying aperture and twisting in the other direction will uncover the stream aperture.

However, in the above described simple pull-type cap with the central pouring aperture only a single dispensing option is provided. A user is unable to select pouring or spraying. Further, in the twisting caps, a tight seal between the stem and the apertures is often not achieved because the stem is merely positioned to cover the apertures and then slide on the undersurface of the tip during the twisting/opening operation. Therefore, a tight seal between the tip and the stem cannot be maintained. Further, it is not convenient to twist a cap in situations where quick and easy access in closing is required.

Presently, bottles are being used as sport drink containers by athletes, especially during exercise activities. These containers require quick and easy access to the contents. Also, since these containers are generally carried with the athlete during exercise, a tight sealing cap is necessary. None of the above cap designs provide convenient access to the contents of the container and a sufficiently tight seal for use during recreation. Also, none of the above containers provide these features with both a spraying and pouring dispensing selection.

SUMMARY OF THE INVENTION

Therefore, it is an object of this invention to provide a cap that creates an excellent seal in a closed position, particularly after repeated opening and closing of the cap.

Another object of this invention is to provide a cap that is easily and quickly opened and closed.

A further object of this invention is to provide a cap that offers both pouring and spraying dispensing capabilities.

An additional object of this invention is to provide a cap that is easily and inexpensively manufactured.

To achieve the above and other objects, a cap is provided that is a pull-type closure comprising a shell adapted to be secured to a container and a tip movably secured to the shell. The shell includes a cylindrical chimney and an upstanding stem member centrally positioned within the chimney with a fluid passage defined therebetween adapted to communicate with the container. The tip has a pouring aperture and at least one spraying aperture and is axially movable with respect to the stem in three positions. The positions include a closed position with the pouring aperture and the spraying aperture sealed from fluid in the container. An intermediate spraying position opens the spraying aperture to fluid communication with the container, and a fully open position opens both the spraying aperture and the pouring aperture to fluid communication with the container.

In particular, the cap according to this invention comprises a resilient shell adapted to be coupled to a container and a resilient inverted cup-shaped tip movably coupled to the shell. The shell includes a shoulder portion for securing to the container, a hollow cylindrical chimney extending outwardly from the shoulder portion with an outer surface with first coupling formations thereon, and an upstanding stem assembly centrally disposed within the chimney and radially inwardly spaced from the chimney by an annular channel. The annular channel has at least one passage therein to the shoulder portion for allowing fluid to pass therethrough from the container. The tip includes a top with an upper surface and a lower surface with a large pouring aperture and at least one small spraying aperture extending therethrough. An outer cylindrical side wall extends from the top and has an interior surface with second coupling formations shaped to interlock with the first coupling formations in a plurality of positions. An annular rib extends from the lower surface of the top of the tip radially inward of the side wall. The side wall and the rib of the tip clamp the chimney of the shell therebetween in three positions. The positions include a closed position with the large pouring aperture and the small spraying aperture sealed off by the stem assembly, a spray position with the large pouring aperture sealed off by the stem assembly, and a pour position with at least the large pouring aperture open and in communication with the fluid passage in the annular channel of the shell.

Other objects, advantages and salient features of the invention will become apparent from the following detailed description, which taken in conjunction with the annexed drawings discloses preferred embodiments of the invention.

BRIEF DESCRIPTION OF THE DRAWINGS

Referring now to the drawings which form a part of this original disclosure.

DETAILED DESCRIPTION OF PREFERRED EMBODIMENTS

Figure 1A:
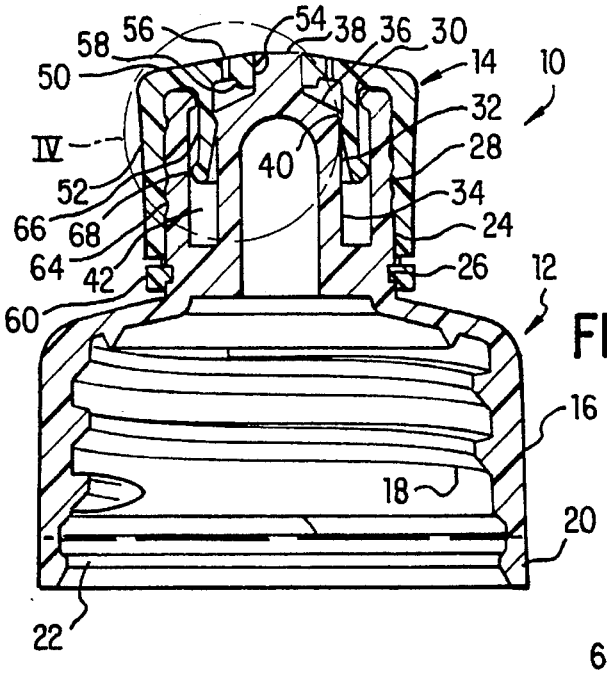
FIG. 1A is a side view of a cap in cross-section in the closed position according to the first embodiment of the invention.

FIGS. 1A–C and 5 show a cap 10 according to this invention. Cap 10 comprises two basic components including a shell 12 and a tip 14 movably secured to shell 12. Both shell 12 and tip 14 are preferably made of resilient material such as plastic. Cap 10 is intended to be used with any type of container and is very well suited for attachment to a plastic squeeze-type bottle.

As shown in FIGS. 1A–C and 2A–B, shell 12 includes an enlarged shoulder portion 16 that is shaped to fit over the mouth of a container. Shoulder portion 16 has internal threads 18 for securing to a threaded mouth of a container. Alternatively, threads 18 could be replaced by a snap-on ring assembly or other conventional fastening mechanism suitable for attachment to the mouth of a container. Also, shoulder 16 could be permanently fixed to a container or molded onto the mouth of the container.

The bottom edge of shoulder 16 has a frangible tamper evident ring 20. Ring 20 has an annular ridge 22 designed to mate with a container. When shell 12 is attached to a container, annular ridge 22 interlocks with a corresponding groove in the container. Then, if shell 12 is removed from the container, frangible ring 20 will break from shoulder portion 16 to provide visual evidence that shell 12 has been removed after assembly. Frangible ring 20 is an optional feature useful for containers with an interlocking groove.

Extending from shoulder portion 16, as shown in FIGS. 1A–C, FIG. 2A and FIG. 5, is a cylindrical, annular, upstanding chimney 24. Chimney 24 has an outer ridged wall designed to engage with tip 14. At the base of the outer wall of chimney 24 is an optional annular base groove 26 having a rectangular cross-section for interlocking with a tamper evident ring on tip 14 described below. Base groove 16 could also be in the form of notched indents.

Figure 2A:
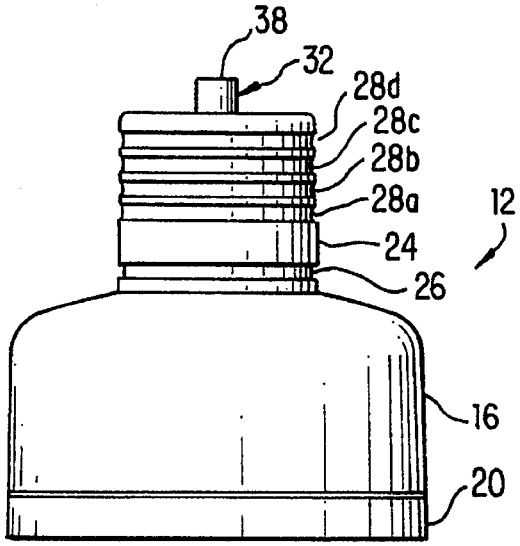
FIG. 2A is a side view of the shell of the cap.

Best seen in FIG. 2A, the outer wall of chimney 24 includes a plurality of axially spaced annular grooves or indents broadly designated as 28 and preferably including four individual grooves 28*a*, 28*b*, 28*c* and 28*d* extending along its length. Each groove 28*a–d* has an arcuate cross-section that is preferably concave but could be convex depending on the complimentary shape of tip 14 described below. Each groove 28*a–d* is separated by a flat ledge portion. Grooves 28 correspond to the different positions that tip 14 is arranged on shell 12.

Figure 1B:
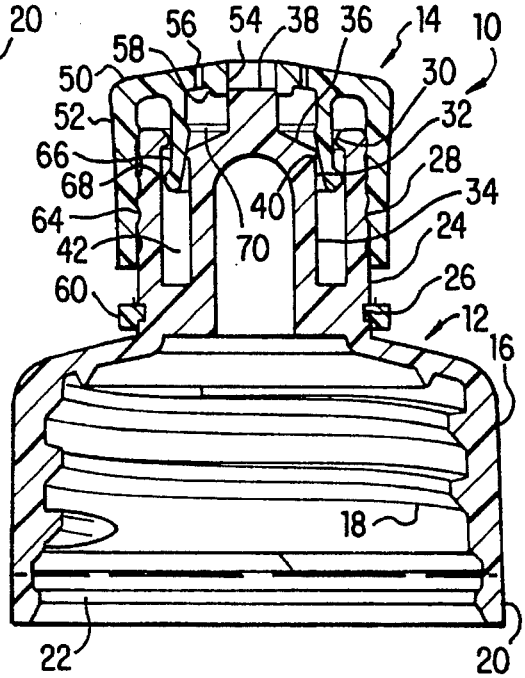
FIG. 1B is a side view in cross-section of the cap in FIG. 1A in the intermediate spraying position.
Figure 1C:
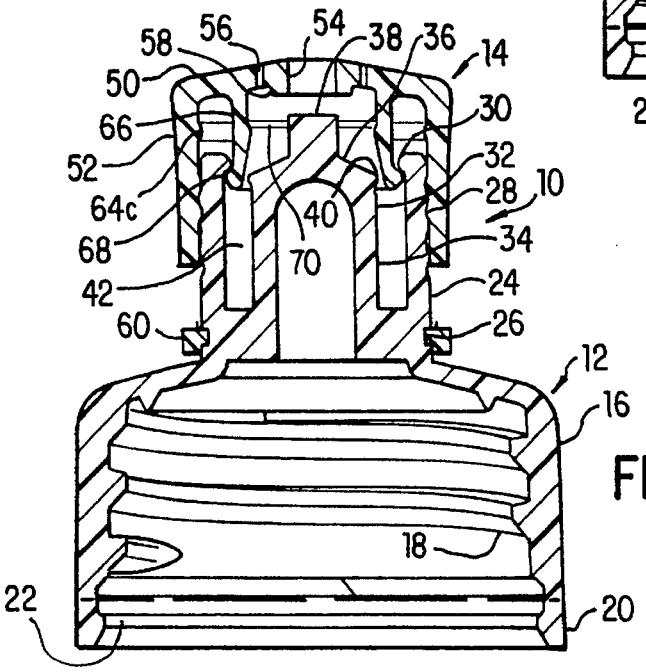
FIG. 1C is a side view in cross-section of the cap of FIG. 1A in the fully open pouring position.

The inside vertical wall of chimney 24 has an upper edge with an inwardly extending radial lip 30 best seen in FIGS. 1A–C. Lip 30 is preferably an annular lip that runs around the entire upper edge of chimney 24.

Centrally disposed within chimney 24 is stem 32. Stem 32 is preferably a hollow cylindrical upstanding tube having an upper closed end that extends beyond chimney 24. The hollow central portion is open to shoulder 16 as shown in FIGS. 1A–C. Stem 32 is formed hollow for simplicity of design and reduction of materials. However, stem 32 could be formed as a solid cylinder. Stem 32 includes a lower enlarged cylindrical section 34 that extends generally parallel to chimney 24. A tapered frustoconical section 36 extends from lower enlarged section 34 and tapers toward a central narrow solid cylindrical plug 38. Best seen in FIG. 4, an enlarged ledge 40 extends from tapered section 36 at the junction with lower enlarged section 34. Ledge 40 is an annular protruding ring that extends toward chimney 24.

Figure 2B:
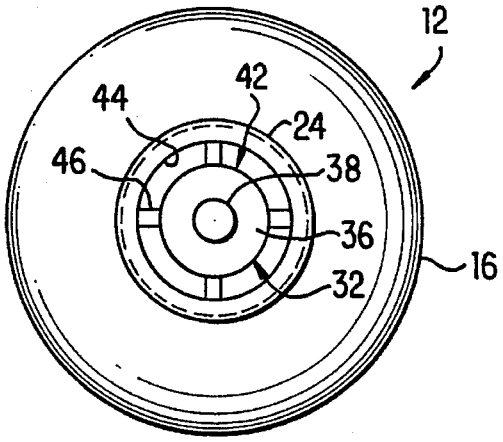
FIG. 2B is a plan view of the shell of FIG. 2A.

An annular channel 42 is provided between chimney 24 and stem 32 and defines a fluid passage from the container to tip 14. The base of channel 42 has fluid passages 44 that extend through chimney 24 into open shoulder portion 16, best seen in FIG. 2B. As seen in FIG. 2B, stem 32 is supported within chimney 24 by support posts 46. Fluid passages 44 are formed by the open areas between support posts 46. Alternatively, annular channel 42 could have a solid base with apertures therein to function as fluid passages.

Figure 3A:
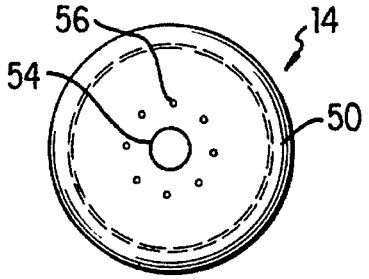
FIG. 3A is a plan view of the tip of the cap of FIG. 1A.
Figure 3B:
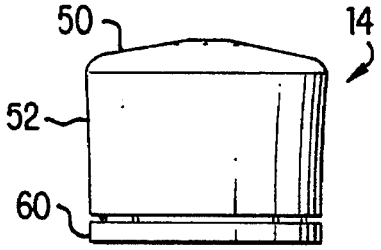
FIG. 3B is a side view of the tip of FIG. 3A.
Figure 3C:
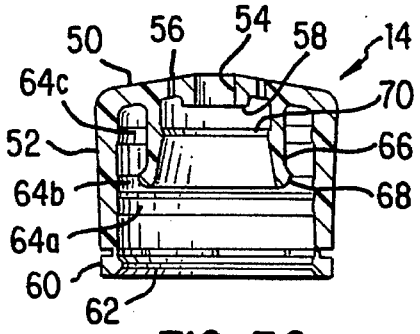
FIG. 3C is a side view in cross-section of the tip in FIG. 3B.

Tip 14 as detailed in FIGS. 3A–C is formed as an inverted cup shaped member having a top 50 and a cylindrical, annular side wall 52. As shown in FIGS. 3A and 3B, top 50 is slightly convex but could be formed as a flat planar member. Formed through top 50 are dispensing apertures, including a large central pouring aperture 54 and a plurality of radially spaced smaller spraying apertures 56 surrounding central pouring aperture 54. As seen in FIGS. 1A–C and FIG. 3C, pouring aperture 54 is surrounded by a sleeve 58 that protrudes from an inner surface of top 50.

Outer sidewall 52 extends from top 50 and tapers slightly inwardly. Since tip 14 is preferably made of resilient plastic, sidewall 52 can flex outwardly. The outer surface of sidewall 52 can either be smooth or textured to provide a gripping surface for a user. Sidewall 52 has an outer edge that includes an optimal frangible tamper evident ring 60. Frangible ring 60 has an inner annular ridge 62 that is designed to interlock with base groove 26 of stem 12 upon assembly. When tip 14 is opened, frangible ring 60 will break from sidewall 52 to provide visual evidence that tip 14 has been opened.

The inner surface of sidewall 52 has a plurality of protruding annular rings collectively shown as 64, including a first ring 64*a*, a second ring 64*b* and a third ring 64*c* best seen in FIG. 3C. Each ring protrudes from the inner surface of sidewall 52 and has an arcuate cross-section preferably convex. Alternatively, rings 64 could be formed as concave grooves to compliment modified convex rings on chimney 24. As shown in FIG. 3C, rings 64*a* and 64*b* are closely spaced together and located in a central region of sidewall 52. Ring 64*c* is spaced from ring 64*b* and located near top 50. Rings 64*a, b* and *c* are identical in size and are shaped to compliment arcuate grooves 28*a, b, c* or *d*. Depending on the position of tip 14 with respect to shell 12, any one of rings 64*a–c* can mate with any one of arcuate grooves 28*a–d*. The three rings 64*a–c* correspond to the three different possible dispensing positions of tip 14 as described below.

Figure 4:
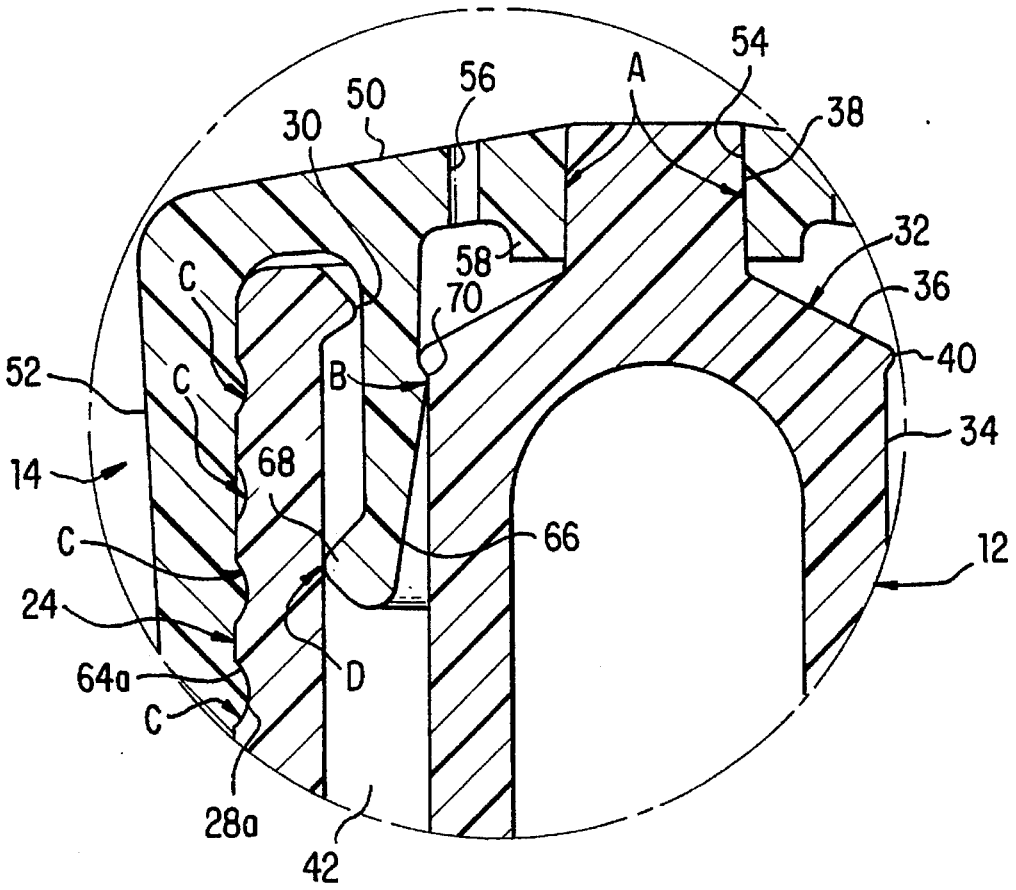
FIG. 4 is an enlarged view of a portion designated IV of FIG. 1A showing the sealing surfaces of the tip and shell of the cap in the closed position.
Figure 5:
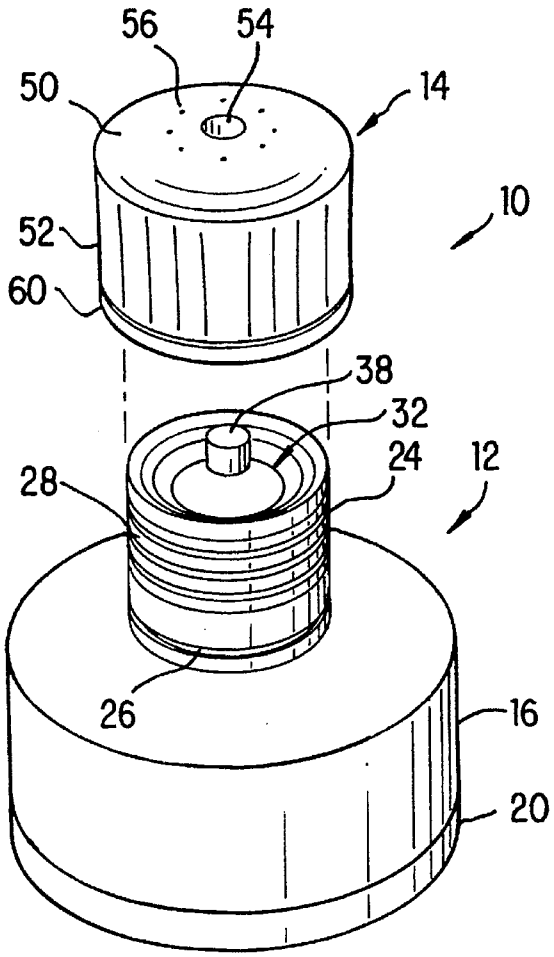
FIG. 5 is an exploded perspective view of the tip and shell prior to assembly of the first embodiment.
Figure 6:
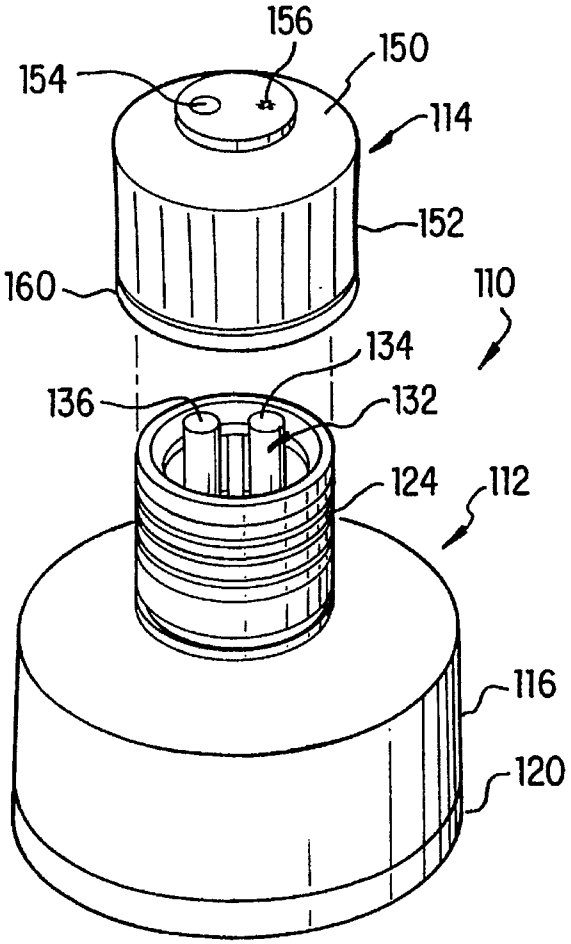
FIG. 6 is an exploded perspective view of the tip and cap prior to assembly of a second embodiment.

Protruding downwardly from the inner surface of top 50 is an annular rib 66 spaced from sidewall 52. Rib 66 flares outwardly toward sidewall 52 and is also resilient. The end of rib 66 is an outwardly extending finger 68 designed to engage inwardly extending lip 30 of chimney 24. Disposed on the inner surface of rib 68 generally aligned with ring 64*c* is an annular indent 70 with an upwardly angled surface. Annular indent 70 is designed to engage enlarged ledge 40 of stem 32 as seen in FIG. 4. Annular rib 66 is shaped to fit over and around stem 32, in particular lower enlarged section 34. Also, rib 66 is spaced from sidewall 52 to provide a clamping channel therebetween to clamp chimney 24, as shown in FIGS. 1A–C.

To assemble cap 10, tip 14 is formed over chimney 24 with the frangible ring 60 engaging base groove 26 as shown in FIG. 1A. Central plug 38 of stem 32 fits sealingly within central pouring aperture 54. Rib 66 surrounds and engages enlarged lower enlarged section 34 of stem 32 within annular channel 42. Annular indent 70 is sealingly engaged with enlarged ledge 40 of stem 32 as shown in FIGS. 1A and 4. Sidewall 52 of tip 14 clamps around chimney 24 of shell 12 and rings 64 mate with grooves 28 in a sealing relationship as shown in FIGS. 1A and 4. Further, finger 68 of rib 66 sealingly engages the inner wall of chimney 24 as shown clearly in FIG. 4. Thus, in the closed position, tip 14 seals annular channel 42 to prevent fluid from passing from shoulder 16 to either pouring aperture 54 or spraying apertures 56.

In the closed position shown in FIGS. 1A and detailed in FIG. 4, four distinct sealing areas A, B, C and D are illustrated. Specifically, central plug 38 is sealed within pouring aperture 54 to provide sealing surface A. Rib 66 is clamped around stem 32 with annular indent 70 sealingly engaging enlarged ledge 40 for a sealing surface B. Sidewall 52 of tip 14 engages chimney 24 and provides sealing surface C at each mating groove 28 and ring 64. Finally, finger 68 of rib 66 sealing presses against the inner surface of chimney 24 providing a fourth sealing surface D. Thus, no fluid will escape from annular channel 42 to top 50 of tip 14.

The second intermediate spraying position is shown in FIG. 1B where tip 14 is axially moved upward along stem 12. Rings 64 are displaced upwardly in grooves 28 and still provide an outer sealing surface C. Also, central plug 38 is still sealingly engaged in central pouring aperture 54 to provide sealing surface A. Similarly, finger 68 is sealingly engaged against the inner surface of chimney 24 to provide sealing surface D, preventing fluid from escaping around chimney 24. However, as seen in FIG. 1B, annular indent 70 is released from beneath enlarged ledge 40 thus providing a passage for fluid from annular channel 42 to spraying apertures 56.

FIG. 1C shows the fully opened pouring position. In this position tip 14 is fully axially moved up chimney 24 of stem 12. Rings 64*a* and *b* still engage grooves 28 of chimney 24, but, as seen in FIG. 1C, ring 64*c* is lifted above chimney 24. Also, finger 68 has axially moved up the inner surface of chimney 24 and engages inward lip 30 in a sealing manner to prevent fluid from escaping around chimney 24. Inward lip 30 also acts as a stop member to prevent tip 14 from becoming disengaged with stem 12. Plug 38 is disengaged from pouring aperture 54 and fluid is free to flow through annular channel 42 between stem 32 and rib 66 and out through both pouring aperture 54 and spraying apertures 56.

To close cap 10, tip 14 is merely pressed down stem 12 toward shoulder 16. Due to the resiliency of sidewall 52 of tip 14 and chimney 24, grooves 28 and ring 64 engage and disengage with a user's pushing and pulling force. Opening cap 10 by pulling tip 14 upward along stem 12 causes frangible tamper evident ring 60 to break from sidewall 52 and remain engaged with base groove 26 as seen in FIGS. 1B and 1C. As shown by the drawings, a reliable seal can be maintained between all sealing surfaces A, B, C and D through repeated opening and closing operations. Further, a user may select the dispensing option of spraying or pouring.

A second embodiment is illustrated in FIGS. 6–11 showing a modified version of cap 110. Those elements of cap 110 that are similar to cap 10 will not be described in detail.

Figure 7A:
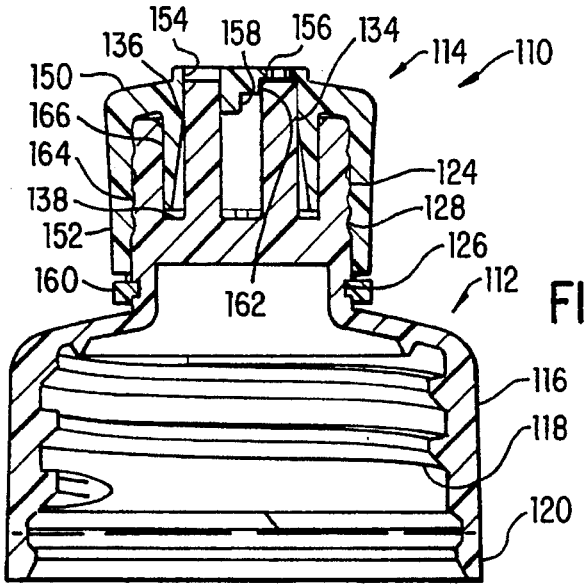
FIG. 7A is a side view in cross-section of the cap in a closed position according to a second embodiment.
Figure 7B:
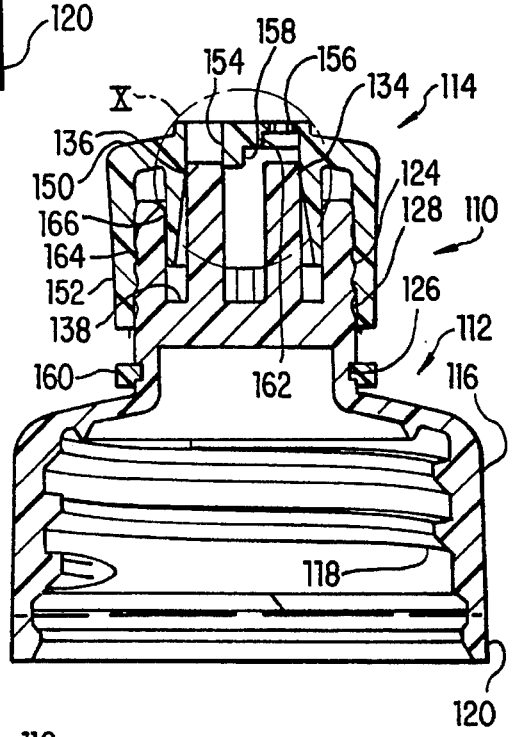
FIG. 7B is a side view in cross-section of the cap of FIG. 7A in the intermediate spraying position.
Figure 7C:
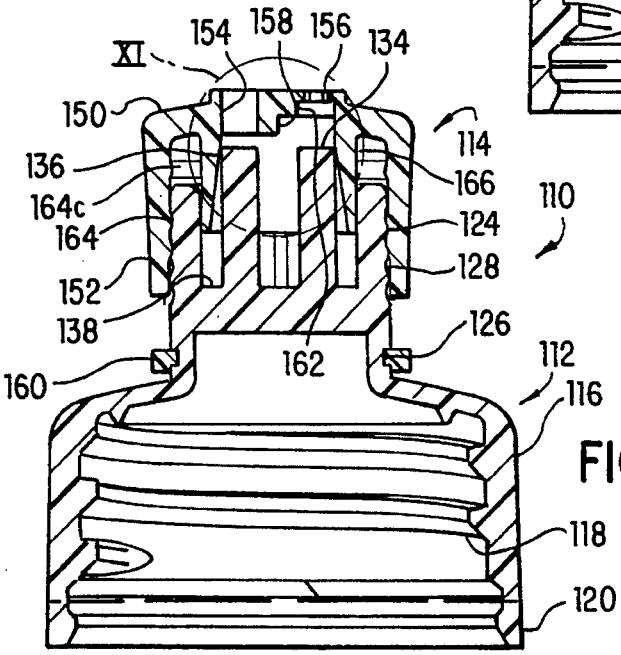
FIG. 7C is a side view in cross-section of the cap of FIG. 7A in the fully opened pouring position.

Cap 110 comprises shell 112 with tip 114 axially movably secured thereto. Shell 112 includes shoulder portion 116 having internal threads 118 and a frangible ring 120 similar to shell 12 of the first embodiment. Shell 112 includes chimney 124 with a base groove 126 for a frangible tamper evident ring and arcuate grooves on its outer wall 128 generally referred to as 128, including grooves 128*a*, 128*b*, 128*c*, and 128*d*. Chimney 124 is shown in FIGS. 7A–C with a smooth inner surface. However, an inwardly extending lip similar to lip 30 of the first embodiment could be used for additional sealing.

Figure 8A:
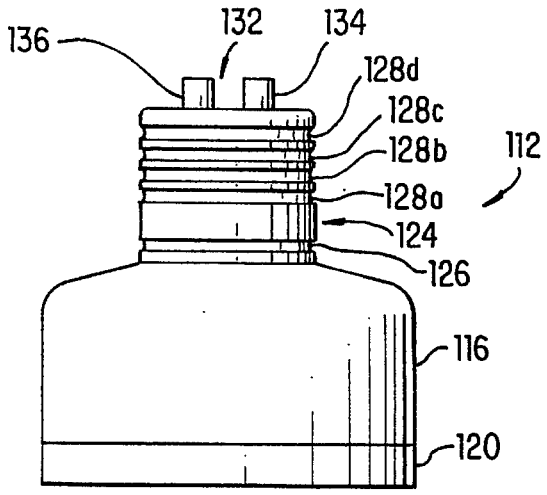
FIG. 8A is a side view of the shell of the cap of FIG. 7A.
Figure 8B:
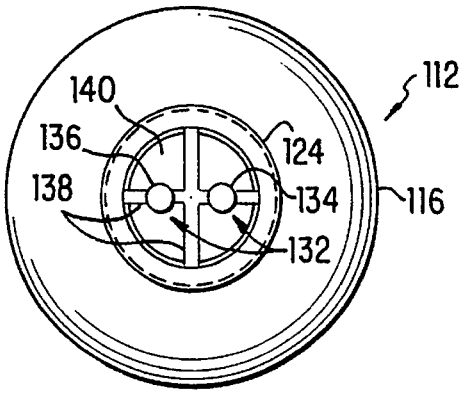
FIG. 8B is a plan view of the shell of FIG. 8A.
Figure 8C:
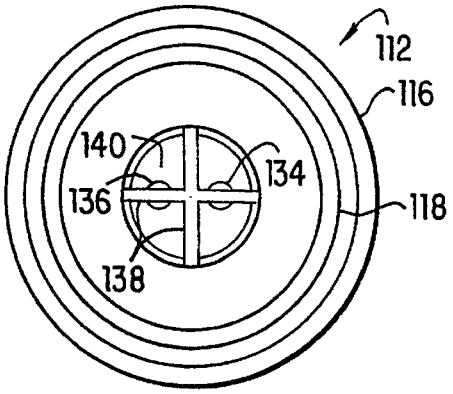
FIG. 8C is a bottom view of the shell of FIG. 8B.

Shell 112 also includes a stem assembly 132 centrally located within chimney 124. Stem assembly 132 comprises a pair of stems 134 and 136 formed as smooth solid upstanding cylinders that extend beyond chimney 124. As shown in FIGS. 8A, 8B and 8C, stems 134 and 136 are equal in size and have the same height. Each stem 134 and 136 is equally spaced from a central longitudinal axis of shell 112 and are located 180° apart. Each stem 134 and 136 is supported by a support post 138 extending across the bottom of chimney 124 as shown in FIGS. 8A and 8C. The stems 134 and 136 are secured to the top of the support post 138 as shown in the bottom view of FIG. 8C. The space between support posts 138 are fluid passages 140 that provide a passage for fluid from shoulder 116 to tip 114.

In this embodiment, the posts 138 are shown as crossed arms. However, the support could take the form of a circular plate with apertures therein to provide fluid passages. Also, the supports could be cantilevered from the inner wall of chimney 124 with no central section. Further, any number of support posts could be used depending on the strength required of the stem assembly.

Figure 9A:
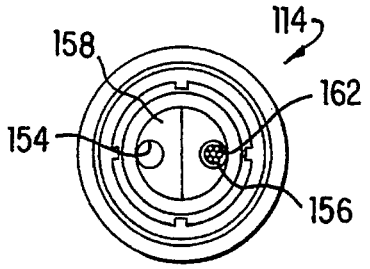
FIG. 9A is a bottom view of the tip of the cap of FIG. 7A.
Figure 9B:
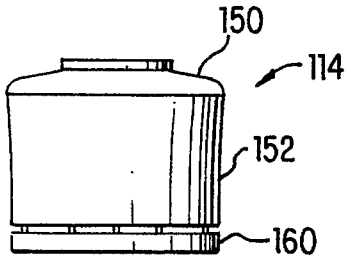
FIG. 9B is a side view of the tip of the cap of FIG. 7A.
Figure 9C:
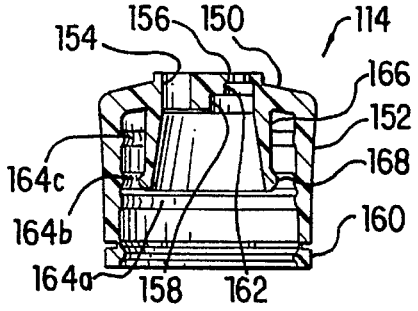
FIG. 9C is a side view in cross-section of the tip of FIG. 9B.

Tip 114 is detailed in FIGS. 9A–C. Tip 114 includes a top 150 shown in FIGS. 9A and 9B as having a flat platform with sloping concave sides. A cylindrical, annular sidewall 152 extends from top 150 and ends in a frangible tamper evident ring 160 similar to ring 60 of the first embodiment. Extending through top 150 is a large pouring aperture 154 and a plurality of radially arranged spraying apertures 156. As shown best in FIG. 9C, aperture 154 is surrounded by a sleeve 158 that protrudes downwardly from the inner surface of top 150. Sleeve 158 can either be ring shaped or constitute a semicircle as shown in FIG. 9A, which is a bottom view of tip 114. Formed on the inner surface of top 150 beneath spraying apertures 156 is a cylindrical indent 162. Both the inner diameter of sleeve 158, which defines pouring aperture 154, and indent 162 are sized to receive stems 134 and 136 in sealing engagement as shown in FIG. 7A.

Pouring aperture 154 and spraying apertures 156 are equally spaced from a centrally longitudinal axis of tip 114 as shown in FIG. 9A. They are positioned to correspond to stems 134 and 136 and are located 180° apart. Spraying apertures 162 are arranged in a circular configuration with the center of the circle being spaced the same distance as the center of the diameter of pouring aperture 154.

The inner surface of sidewall 152 of tip 114 has annular convex rings 164 collectively referred to as 164, including rings 164*a*, 164*b* and 164*c* similar to rings 64 of the first embodiment. Rings 164 releasably engage with grooves 128 of chimney 124. Rings 164 are positioned in the same manner as rings 64 of the first embodiment.

Extending downwardly from the inner surface of top 150 is a cylindrical, annular rib 166. Rib 166 shown in FIG. 7A–7C is flared outwardly with a planar wall facing sidewall 152 and a tapered inner wall. Alternatively, as shown in FIG. 9C, rib 166 can include an outwardly extending annular finger 168 to provide sealing engagement with chimney 124 as described in the first embodiment.

Figure 10:
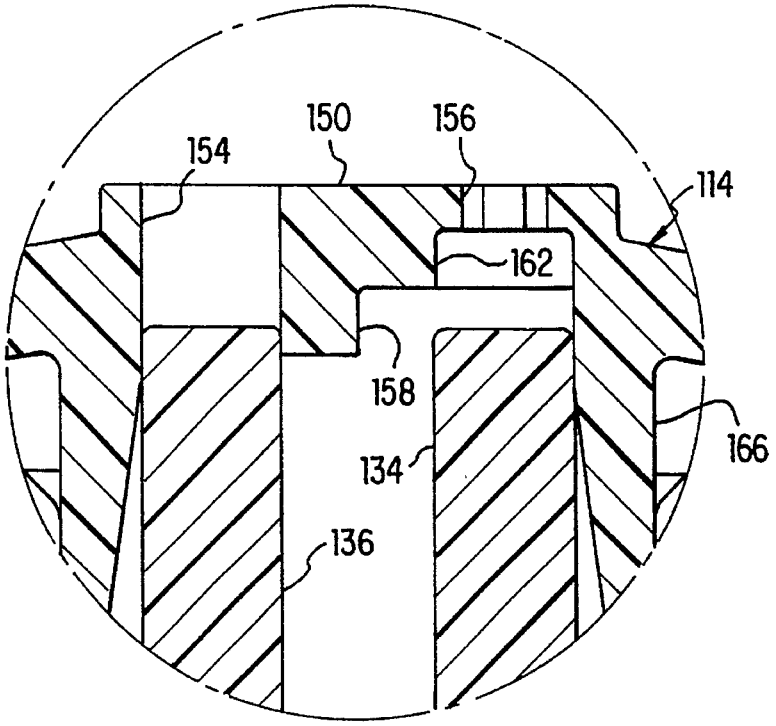
FIG. 10 is an enlarged view of a portion designated X of FIG. 7B.
Figure 11:
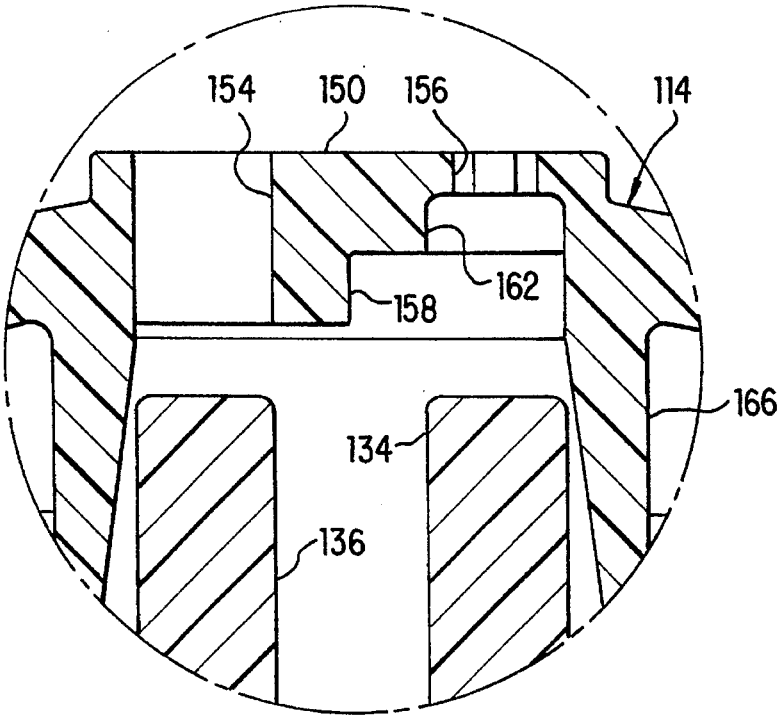
FIG. 11 is an enlarged view of a portion designated XI of FIG. 7C.

FIG. 7A–7C show the operation of cap 110 with FIGS. 10 and 11 highlighting the spraying and pouring positions. As shown in FIG. 7A, in the closed position, tip 114 fits over chimney 124 of shell 112. Frangible tamper evident ring 160 locks into base groove 126. Grooves 128 in chimney 124 mate with rings 164 in sealing engagement to prevent fluid from flowing around the chimney 124. Sidewall 152 of tip 114 and rib 166 clamp around chimney 124 in a sealing relationship. Stem 134 sealingly engages an indent 162 to seal off spraying apertures 156. Stem 136 sealingly engages pouring aperture 154 by fitting within sleeve 158 to seal off the pouring aperture 154. In this position, fluid is not permitted to enter apertures 154 or aperture 156 and is prevented from leaking out beyond chimney 124 and tip 114.

In the intermediate spraying position shown in FIG. 7B and FIG. 10, tip 114 is axially moved up stem 112 by disengaging and engaging grooves 128 and rings 164 similar to cap 10 described in the first embodiment. In this position, stem 136 is still engaged within sleeve 158 to seal off pouring aperture 154 as highlighted in FIG. 10. However, stem 134 is displaced from indent 162 allowing fluid to pass through fluid passage 140 past stem assembly 132 through spraying apertures 156. Similar to the first embodiment, by pulling tip 114 up from the initial closed position, frangible tamper evident ring 160 is separated from sidewall 152.

The third open pouring position is shown in FIG. 7C and FIG. 11. In this position, tip 114 is axially moved farther up chimney 124 of stem 112. Grooves 128 and rings 164 are still sealingly engaged to prevent fluid from leaking beyond chimney 124. However, in addition to stem 134 being displaced from indent 162, stem 136 is spaced from sleeve 158 to open pouring aperture 154. Thus, fluid is permitted to flow through fluid passage 140 past stem assembly 132 to both pouring aperture and spring apertures 156.

The resiliency of outer wall 152 and rib 166 of tip 114 and chimney 124 of stem 112 allows tip 114 to repeatedly move up and down along chimney 124 and maintain a sealing engagement therewith. Because stems 134 and 136 fit within sleeve 158 and indent 162, respectively, rather than merely covering a flat surface with apertures therein, a tight seal is maintained over these apertures when a user desires them to be closed.

It is possible to modify the second embodiment by using a stem assembly with a pair of stems having unequal heights and a tip 114 having a top with apertures therein and a flush inner surface. In that way, selective spraying and pouring could be accomplished.

While advantageous embodiments have been chosen to illustrate the invention, it will be understood by those skilled in the art that various changes and modifications can be made therein without departing from the scope of the invention as defined in the appended claims.

What is claimed is:

1. A pull-type closure comprising:

a shell adapted to be secured to a container, including a cylindrical chimney and an upstanding stem member centrally positioned within said chimney with a fluid passage defined therebetween adapted to communicate with the container; and a tip coupled to said shell having a pouring aperture and at least one separate spraying aperture, said tip being axially movable with respect to said stem in three positions, including a closed position with said pouring aperture and said at least one spraying aperture sealed from the container, an intermediate spraying position with said at least one spraying aperture in fluid communication with the container, and a fully open position with said at least one spraying aperture and said pouring aperture in fluid communication with the container.

2. The pull-type closure of claim 1 wherein said shell further comprises a threaded shoulder extending from said chimney for securing to a container in fluid communication with said chimney.

3. The pull-type closure of claim 2 wherein said shoulder has an outer edge with a frangible tamper-evident ring thereon that breaks from said shoulder when said closure is removed from the container.

4. The pull-type closure of claim 1 wherein said chimney has an outer surface with a plurality of spaced annular grooves therein that interlock with said tip.

5. The pull-type closure of claim 4 wherein said grooves are positioned to correspond to the three positions of said tip.

6. The pull-type closure of claim 4 wherein said tip has an inner surface with a plurality of spaced annular rings that sealingly engage at least some of said spaced annular grooves in each of the three positions.

7. The pull-type closure of claim 1 wherein said chimney has an outer edge that abuts said tip and an inner surface with an inwardly radial lip that provides a stop surface for the axial movement of said tip in the fully open position.

8. The pull-type closure of claim 1 wherein said chimney is resilient and said tip is resilient and said tip axially slides over said chimney in the three positions.

9. The pull-type closure of claim 1 wherein said stem member comprises a post having a lower enlarged section extending generally parallel to said chimney, a tapered section extending from said lower enlarged section toward said tip, and a central narrow solid cylindrical plug shaped to fit in said pouring aperture extending toward said tip beyond said chimney.

10. The pull-type closure of claim 9 wherein said lower enlarged section has an outwardly extending annular ledge adjacent said tapered section that provides a sealing surface between said tip and said shell when said tip is in the closed position.

11. The pull-type closure of claim 1 wherein said fluid passage is an annular channel with a base groove having a plurality of apertures therein.

12. The pull-type closure of claim 11 wherein said base groove has four radially spaced apertures therein.

13. The pull-type closure of claim 1 wherein said stem member comprises a pair of upstanding stems of equal length extending beyond said chimney and shaped to fit in said pouring aperture and to cover said at least one spraying aperture.

14. The pull-type closure of claim 13 wherein said stems are equally spaced from a center longitudinal axis of said shell.

15. The pull-type closure of claim 14 wherein said stems are arranged approximately 180° apart.

16. The pull-type closure of claim 13 further comprising a support extending from said chimney and coupled to said stems for supporting said stems in an upright position.

17. The pull-type closure of claim 16 wherein said support structure comprises a pair of crossed support arms with open areas therebetween defining said fluid passage.

18. The pull-type closure of claim 1 wherein said tip is a resilient inverted cup having a top with an outer and an inner surface and a cylindrical side wall extending from said top, wherein said pouring aperture and said at least one spraying apertures are located in said top.

19. The pull-type closure of claim 18 wherein said cylindrical side wall has an inner surface with a plurality of annular rings protruding therefrom corresponding to the three positions of the tip and configured to mate with said chimney.

20. The pull-type closure of claim 18 wherein said pouring aperture is a large central aperture and said at least one spraying aperture is a plurality of small apertures surrounding said large central aperture.

21. The pull-type closure of claim 20 wherein said pouring aperture comprises a sleeve that protrudes outwardly from said inner surface of said top toward said stem member.

22. The pull-type closure of claim 18 wherein said tip further comprises an annular rib extending from said inner surface of said tip toward the shell and spaced from said side wall to be positioned between said chimney and said stem member of said shell.

23. The pull-type closure of claim 20 wherein said annular rib is resilient and flares outwardly toward said side wall.

24. The pull-type closure of claim 22 wherein said annular rib ends in an outwardly extending finger that acts as a stop when said tip is in the fully open position.

25. The pull-type closure of claim 22 wherein said annular rib has an inner surface facing a center longitudinal axis of said tip with an upwardly angled annular indent that interlocks with said stem in the closed position.

26. The pull-type closure of claim 18 wherein said pouring aperture is a large aperture and said at least one spraying aperture is a plurality of small apertures arranged in a ring having a center, wherein said pouring aperture and said center of said spraying apertures are equally spaced from a center longitudinal axis of said top.

27. The pull-type closure of claim 26 wherein said pouring aperture and said spraying apertures are disposed 180° from each other.

28. The pull-type closure of claim 26 further comprising a sleeve surrounding and defining said pouring aperture and extending from said inner surface of said top, and a cylindrical indent surrounding said spraying apertures formed in said inner surface of said top, wherein said stem member mates with said sleeve and said indent in the closed position and mates only with said sleeve in said intermediate position.

29. The pull-type closure of claim 1 wherein said tip has an outer edge with a frangible tamper-evident ring thereon and said shell has an annular groove with a rectangular cross section, wherein said ring mates with said annular groove when said tip is assembled on said shell and said ring breaks from said tip when said tip is moved from the closed position.

30. A cap for a container comprising:

a resilient shell adapted to be coupled to a container, comprising a shoulder portion for securing to the container, a hollow cylindrical chimney extending outwardly from said shoulder portion having an outer surface with first coupling formations thereon, and an upstanding stem assembly centrally disposed within said chimney and radially inwardly spaced from said chimney by an annular channel, said annular channel having at least one passage therein to said shoulder portion for allowing fluid to pass therethrough from the container; and a resilient inverted cup-shaped tip movably coupled to said shell comprising a top with an upper surface and a lower surface with a large pouring aperture and at least one small spraying aperture extending therethrough, an outer cylindrical side wall extending from said top with an interior surface having second coupling formations shaped to interlock with said first coupling formations in a plurality of positions, and an annular rib extending from said lower surface radially inward of said side wall, wherein said side wall and said rib of said tip clamp said chimney therebetween in three positions, including a closed position with said large pouring aperture and said at least one small spraying aperture sealed off by said stem assembly, a spray position with said large pouring aperture sealed off by said stem assembly, and a pour position with at least said large pouring aperture open and in communication with said at least one passage in said annular channel of said shell.

31. The cap of claim 30 wherein said shoulder has an outer edge with a frangible tamper-evident ring thereon that breaks from said shoulder when said cap is removed from the container.

32. The cap of claim 30 wherein said first coupling formations are a plurality of spaced annular grooves and said second coupling formations are a plurality of corresponding spaced annular rings, wherein said grooves and said rings are positioned to correspond to the three positions of said tip and at least some of said rings sealingly engage at least some of said grooves in each of the three positions.

33. The cap of claim 30 wherein said chimney has an outer edge having an inwardly radial lip that abuts said rib of said tip in the pour position and inhibits removal of said tip from said shell.

34. The cap of claim 30 wherein said stem assembly comprises a post having a lower enlarged section extending generally parallel to said chimney, a tapered section extending from said lower enlarged section toward said tip, and a central narrow solid cylindrical plug shaped to fit in said pouring aperture extending toward said tip beyond said chimney.

35. The cap of claim 34 wherein said lower enlarged section has an outwardly extending annular ledge adjacent said tapered section that functions as a sealing surface between said annular rib of said tip and said shell when said tip is in the closed position.

36. The cap of claim 30 wherein said stem assembly comprises a pair of upstanding stems of equal length extending beyond said chimney and shaped to fit in said pouring aperture and to cover said at least one spraying aperture.

37. The cap of claim 36 wherein said stems are equally spaced from a center longitudinal axis of said shell.

38. The cap of claim 36 wherein said stems are arranged approximately 180° apart.

39. The cap of claim 36 further comprising a support extending from said chimney and coupled to said stems for supporting said stems in an upright position.

40. The cap of claim 39 wherein said support structure comprises a pair of crossed support arms with open areas therebetween defining said fluid passage.

41. The cap of claim 30 wherein said pouring aperture is a large central aperture and said at least one spraying aperture is a plurality of small apertures surrounding said large central aperture.

42. The cap of claim 30 wherein said pouring aperture comprises a sleeve that protrudes outwardly from said inner surface of said top toward said stem assembly.

43. The cap of claim 30 wherein said annular rib flares outwardly toward said side wall and ends in an outwardly extending finger that acts as a stop with said chimney when said tip is in the pour position.

44. The cap of claim 30 wherein said annular rib has an inner surface facing a center longitudinal axis of said tip with an upwardly angled annular indent that interlocks with said stem in the closed position.

45. The cap of claim 30 wherein said pouring aperture is a large aperture and said at least one spraying aperture is a plurality of small apertures arranged in a ring having a center, wherein said pouring aperture and said center of said spraying apertures are equally spaced from a center longitudinal axis of said top.

46. The cap of claim 45 wherein said pouring aperture and said spraying apertures are disposed 180° from each other.

47. The cap of claim 45 further comprising a sleeve surrounding and defining said pouring aperture and extending from said lower surface of said top, and a cylindrical indent surrounding said spraying apertures formed in said lower surface of said top, wherein said stem assembly mates with said sleeve and said indent in the closed position and mates only with said sleeve in the spray position.

48. The cap of claim 30 wherein said tip has an outer edge with a frangible tamper-evident ring thereon and said shell has an annular groove with a rectangular cross section, wherein said ring mates with said annular groove when said tip is assembled on said shell and said ring breaks from said tip when said tip is moved from the closed position.

* * * * *